United States Patent [19]

Hahn

[11] 4,162,767

[45] Jul. 31, 1979

[54] IMPACTING CRUSHER WITH VARIABLE FLOW FEED DISTRIBUTOR

[75] Inventor: William F. Hahn, Devon, Pa.

[73] Assignee: Pennsylvania Crusher Corporation, Broomall, Pa.

[21] Appl. No.: 849,142

[22] Filed: Nov. 7, 1977

[51] Int. Cl.[2] ..... B02C 13/286

[52] U.S. Cl. ..... 241/30; 222/77; 222/198; 241/34; 241/186 R

[58] Field of Search ..... 241/27, 30, 34, 186 R, 241/186.2, 202, 224, 225; 222/52, 58, 77, 198, 310

[56] References Cited

U.S. PATENT DOCUMENTS

| | | | |
|---|---|---|---|
| 1,075,040 | 10/1913 | Kelly | 222/310 X |
| 2,764,361 | 9/1956 | Moore | 241/186.2 X |
| 3,693,836 | 9/1972 | Eisner | 222/77 |
| 3,857,519 | 12/1974 | Schafer et al. | 241/186 R |

FOREIGN PATENT DOCUMENTS

| | | | |
|---|---|---|---|
| 1087881 | 8/1960 | Fed. Rep. of Germany | 241/225 |

*Primary Examiner*—Howard N. Goldberg
*Attorney, Agent, or Firm*—Pollock, Vande Sande & Priddy

[57] ABSTRACT

An impacting crusher with a relatively wide rotor is adapted to receive its feed material from a relatively narrow conveyor, while establishing even distribution of wear across the rotor. Periods of operation between rotor overhaul and replacement are extended. Machines with adjustable cages may require less frequent cage adjustments, and are generally capable of a larger number of cage adjustments (with more favorable effect on machine performance). The relatively narrow conveyor feeds feed material to an enclosure which is adapted to maintain an inventory of such material and has an opening through which it discharges the material from the inventory to the rotor. The opening is elongated in a direction generally parallel to the rotor axis, is about as long as the width of the rotor, has its ends positioned substantially above the ends of the rotor, and is of substantially uniform width along its length. Means are provided to respectively increase and decrease the width of the elongated opening in response to increased and decreased inventory of material in the feeder, while retaining sufficient inventory to keep the entire length of the opening covered. Thus, although the width of the opening and the overall mass rate of material passing through it may fluctuate if the feed from the conveyor fluctuates, the mass flow through the opening is distributed substantially uniformly across its length. Thus, the material is distributed substantially uniformly across the width of the rotor, causing it to wear evenly across its width over an extended period of operation.

27 Claims, 6 Drawing Figures

2
13
62
12
11
59
63
58
10
65
61
42
17
35
41
22
21
14
20
31
16
B
30
A
37
33
36
54
52
39
53
56
50
51
57
55
34
40
67
44
64
24
43
18
19
69
75
74
102
100
77
90
94
15
103
99
96
92
91
95
97
71
70
88
98
89
100
100
72
82
86
87
85
84
83
76
79
78
68
2

FIG 3
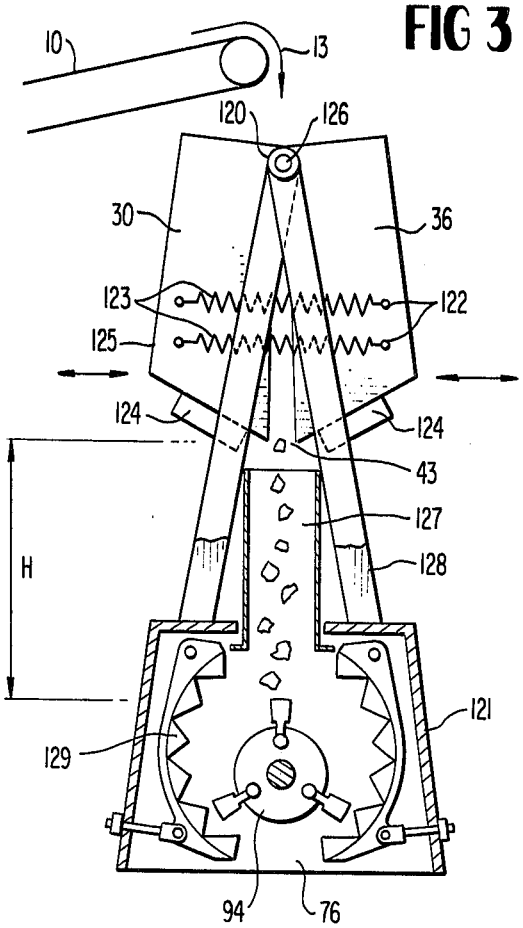
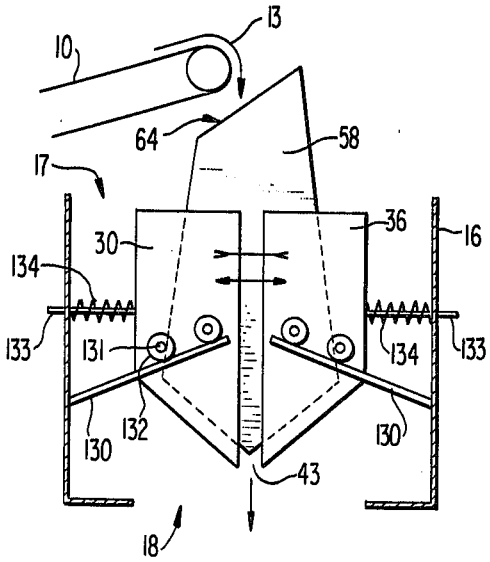
FIG 4
FIG 5
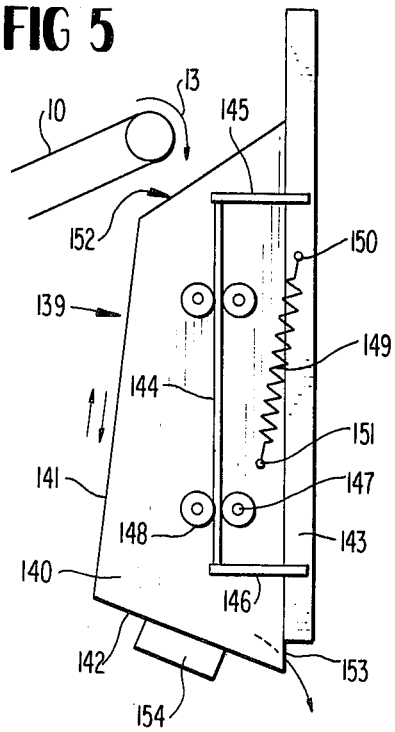
FIG 6
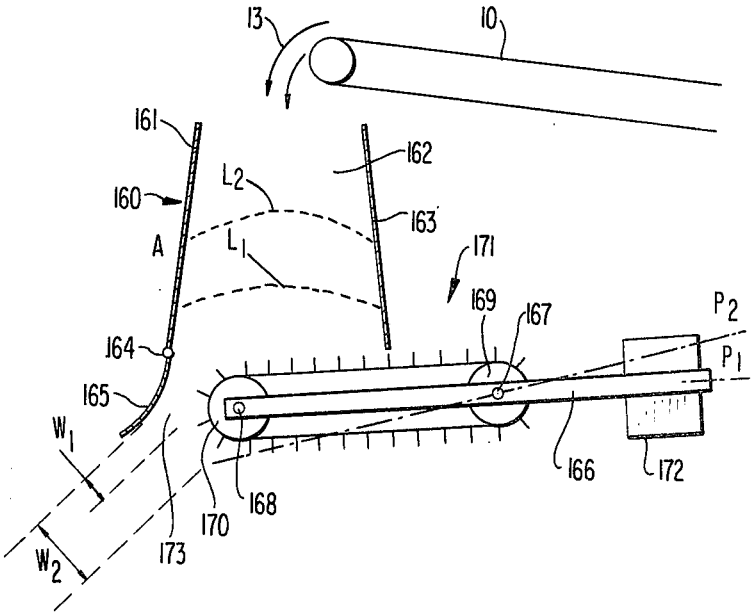

IMPACTING CRUSHER WITH VARIABLE FLOW FEED DISTRIBUTOR

BACKGROUND OF THE INVENTION

This invention relates to impacting crushers. Nonlimiting examples include one way and reversible hammermills, in-out machines, over and out machines, ring type granulators, impactors and other machines with and without grates, breaker blocks, cage bars and the like surrounding the rotor. In general, such machines are designed to shatter hard and/or abrasive mineral material such as metal ores, coal, stone and glass. Shattering is caused at least in part and to a substantial extent by high energy collision between the material and angularly spaced rotating impact members, such as hammers, rings, bars, paddles or other striking members. These extend outwardly from a rotating shaft mounted for rotation in a surrounding housing provided with a feed inlet and a reduced material discharge outlet. When fully extended by centrifugal force, the peripheries of the impact members travel in what is referred to as a "hammer circle".

The high levels of kinetic energy produced in such machines and the hardness and abrasiveness of the feed materials tend to abrasively wear away those portions of the impact member surfaces which are involved in the collisions. Such wear tends to degrade machine performance, with some machines varying from others in the extent and manner in which they are affected by such wear. Eventually, wearing of the impact members proceeds to the point where compensating adjustment, overhaul or parts replacement becomes necessary.

Impacting crushers are generally employed in high tonnage continuous operations in which the machines are fed by conveyors, such as for example conveyor belts, drag link conveyors, screw conveyors, vibrating conveyors and others. Conveyor cost factors and impacting crusher capacity considerations have generally resulted in relatively narrow conveyors being used to feed machines with relatively wide rotors. Assume that one's object is to select a combination of conveyor and impacting crusher capable of conveying stone, coal or the like over an extended distance and then crushing it with minimum capital investment. Conveyor capital costs can be held to a minimum by employing a conveyor of minimum width relative to the required through-put capacity. However, the state of the art of impacting crusher design being what it is, it has generally been considered necessary that the rotor be several times wider than the width of the conveyor, e.g. 3–4 times wider, in order to handle capacity through-put from the conveyor without choking. Because of these and other factors, there are in existence today many installations using impacting crushers with relatively wide rotors which are fed by relatively narrow conveyors.

Such installations are subject to a number of problems which have been evident for many years. Assuming that a narrow width discharge from a conveyor belt is directed to the center of a relatively wide rotor, the central portion of the rotor sustains more wear per unit of oeprating time than its side portions. Thus, for instance, if the impacting crusher is a hammermill having a plurality of groups of hammers arranged side by side along the axis of the rotor, the center groups of hammers may be worn excessively when the hammers in the side groups are still serviceable. Had such uneven wear not occurred, the machine could have operated for a longer interval and still maintained desired product size. On the other hand, if the impacting crusher is of a type which requires a certain critical clearance between the hammer circle and an adjustable surrounding cage, it may not be possible to fully utilize the wearing capabilities of the central portion of the rotor; the differences between the diameter of the central portion and less worn side portions of the rotor may be sufficient so that when the cage is adjusted for proper clearance relative to the central portion of the rotor, there may be inadequate clearance or even interference between the cage and the side portions of the rotor.

Another known problem relates to the matter of where and in what direction the feed material penetrates the circle described by the periphery of the rotor, i.e. the hammer circle. A given design of impacting crushers ordinarily has an optimum penetration location. For example, the optimum area of penetration is generally top dead center in a reversible machine. In hammermills with sloping breaker plates, the optimum area is often the "pinch point", the location where the impact members approach closest to the breaker plate. The extent to which feed material penetration deviates from the desired location can produce safety and maintenance problems. For example, in machines wherein the pinch point is the optimum penetration location, material not entering at the pinch point can cause ricocheting, sometimes referred to as "foul balling", with heavy chunks of material being thrown back up into the feed connection chutes between the crusher housing and the conveyor. This can be both damaging and dangerous. This same difficulty is promoted if the feed enters at the optimum location but in varying directions. Thus, vertical penetration is preferred.

A troughed belt is the type of conveyor most commonly used to feed impacting crushers. Such belt/crusher installations are usually designed in a manner such that the feed materials depart the belt on a longitudinally spreading trajectory of narrow width with both horizontal and vertical components of motion. Special guide chutes have been used in some cases to limit the horizontal motion and/or longitudinal spread of the conveyor discharge. However, certain of these designs cause significant bouncing of the feed material back and forth between the interior walls of the chute, so that fewer particles enter the hammer circle on the desired vertical path.

Another problem is the matter of the speed at which the feed material penetrates the hammer circle. In a given machine, operating at a given rotor speed, there will be an optimum speed at which the feed material should penetrate the hammer circle for most effective size reduction and through-put. The speed of penetration of the feed generally depends on the height from which it drops from the conveyor to the hammer circle. The above-described special delivery chutes for confining longitudinal spread of the conveyor discharge complicate the attainment of the desired penetration speed. When sufficiently effective in stream confinement, they can exert sufficient friction on the feed to significantly alter its penetration speed, in some cases resulting in less than adequate speed of penetration. Thus, it has been a problem in the art to obtain in combination even wear across the rotor, along with optimum location, direction and speed of penetration into the hammer circle.

Impacting crushers have been in use for over half a century and have been fed improperly by relatively narrow conveyors for most of that period. For dozens of years persons skilled in the art have observed the problems described above and the extra costs arising from these problems. Various attempts have been made to design serviceable distributing devices for distributing feed material more evenly to impacting crushers. However, such designs have not achieved widespread acceptance as a solution to the problem, as evidenced by the fact that there are many installations in existence which are being operated without any feed distributor whatsoever, and in which the operators continue to tolerate the extra maintenance and expense of uneven rotor wear. Moreover, new installations are being made which are subject to the same problems. Accordingly, it appears that there is a continuing need for improved impacting crushers with feed distributors capable of maintaining even distribution of wear across the rotor.

SUMMARY OF THE INVENTION

The foregoing problems have been reduced or eliminated by the apparatus and method of the present invention.

The apparatus aspect of the present invention is the combination of an impacting crusher and a feed distributor as described below. The impacting crusher includes a housing in which a shaft is mounted for rotation. The shaft has rotating impact members mounted thereon and extending outwardly from the shaft along a given length of said shaft to define a relatively wide rotor. The housing further includes an inlet of about the same width as the rotor or wider to present feed material to the rotor and a discharge outlet for crushed material. The distributor is adapted to receive, from a conveyor, a substantially continuous input stream of particulate solid material, which stream has a given maximum horizontal width dimension, and may exhibit uniform or variable depth, mass flow rate, and particle size. The distributor includes an enclosure which is defined by confining means for surrounding an inventory of material laterally and from beneath. The confining means includes at least one moveable supporting member which defines a portion of the sides and/or bottom of the enclosure, and which is positioned to bear at least a portion of the weight of the inventory. The enclosure is openable by movement of the moveable member to define an opening which is presented to the rotor, is elongated in a horizontal direction generally parallel to the rotor axis, is about as long as the width of the rotor, is positioned with its ends substantially above the ends of the rotor and is of substantially uniform width across the width of the rotor. The opening is defined between said moveable member and an adjoining portion of the confining means, which portion may be a moveable member or a stationary portion of the confining means. The moveable member or members is or are connected with closing means having the property of exerting sufficient closing force on said moveable member or members to keep the entire length of said opening covered by said inventory while said inventory is flowing through the opening, and being responsive to the inventory present in the enclosure for respectively decreasing and increasing the width of said opening in response to decreased and increased inventory. Although such apparatus permits the overall mass rate of material passing through the opening to fluctuate as the feed from the conveyor fluctuates, the mass flow is distributed substantially uniformly across the length of the opening, so that the side and central portions of the rotor receive substantially equal quantities of the material over an extended period of operation.

According to the method aspect of the invention, particulate solid material, in a stream having a given maximum horizontal width dimension and characterized by uniform or variable depth, flow rate and particle size, is fed substantially continuously from a conveyor to an enclosure. An inventory of the material is maintained in the enclosure. Material is fed from said inventory to the rotor of an impacting crusher through an opening in the enclosure which is elongated in a horizontal direction generally parallel to the rotor axis, is about as long as the width of the rotor, is positioned with its ends substantially above the ends of the rotor and is of substantially uniform width across the width of the rotor. The opening width is respectively decreased and increased as the inventory decreases and increases, while maintaining the opening sufficiently small to keep the opening covered with said inventory. Moreover, certain preferred embodiments of the method include additional desireable steps or conditions. For instance, the opening may be arranged to release the material in vertical free fall. Also, the stream of material can be released from the opening at a predetermined height above the rotor and pass to the rotor without substantial redirectly of the stream by intervening guide members until it contacts the rotor or hammer circle. Additionally, the material can be caused to penetrate the hammer circle at a predetermined location, such as at the top dead center position of a reversible impacting crusher.

Various improvements on the foregoing inventions may be found in the accompanying description of certain preferred embodiments, which are illustrated in the accompanying drawings.

BRIEF DESCRIPTION OF THE DRAWINGS

FIGS. 3–6 are schematic views of alternate forms of the distributor.

Figure 1:
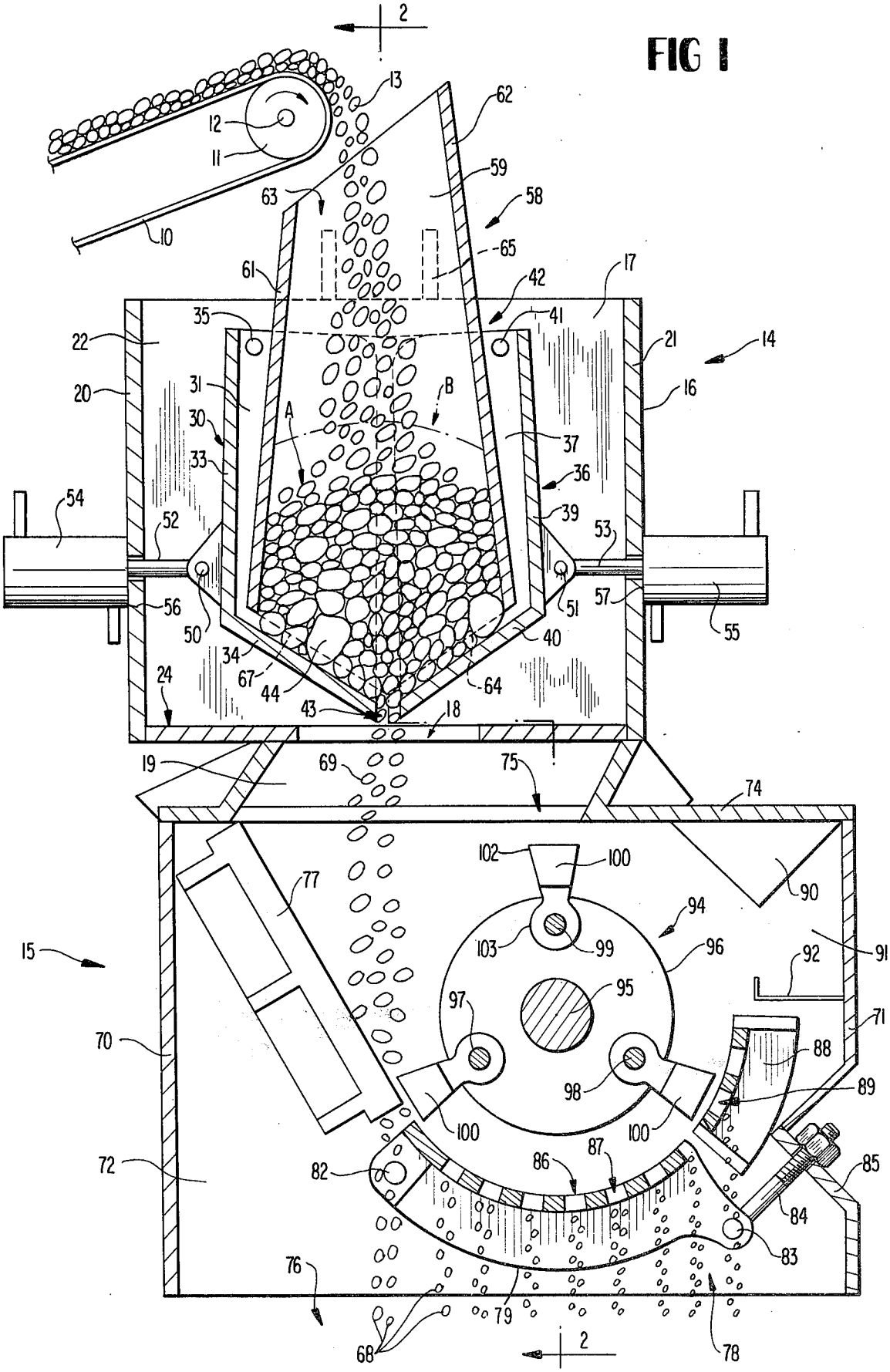
FIG. 1 is a vertical longitudinal section, perpendicular to and at the mid-point of the rotor axis.
Figure 2:
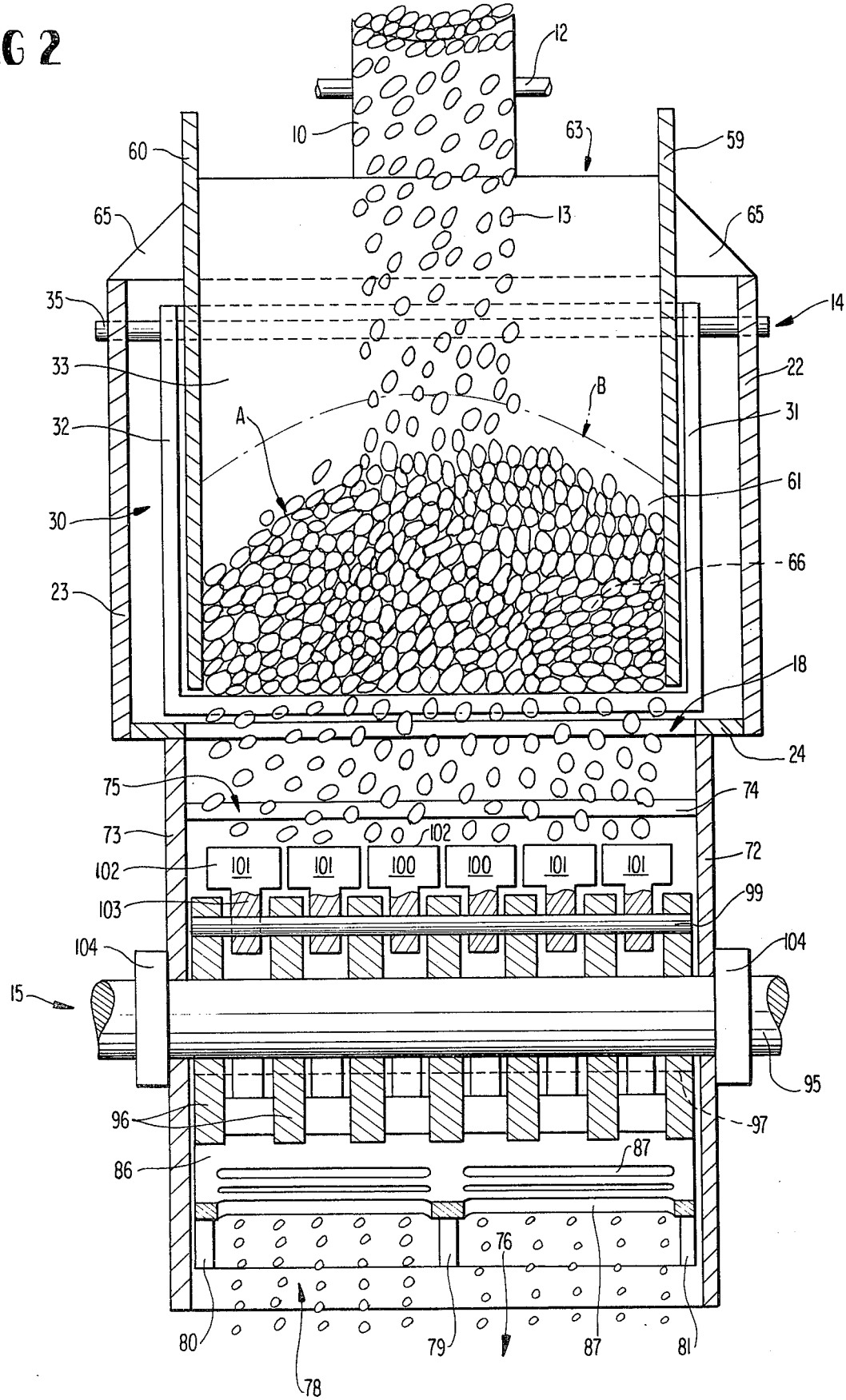
FIG. 2 is a transverse section taken along partially displaced section line 2—2 in FIG. 1.

A first embodiment of the invention is disclosed in FIGS. 1 and 2. A troughed high capacity conveyor belt 10 having end roll 11 rotatable on shaft 12 is positioned to deliver feed material 13 to a feed distributor 14. The latter, in turn, is positioned to deliver the feed material to impacting crusher 15.

Feed distributor 14 includes an outer casing 16 defined by upright wall means, such as front wall 20, rear wall 21, side walls 22 and 23, and bottom wall 24, and has an open top 17. Bottom wall 24 includes a bottom outlet 18 in registry with the hammermill inlet 19 at the top of the hammermill housing.

By means of pivot shafts 35 and 41, supported in the upper portions of outer casing side walls 22 and 23, is a clam shell arrangement. It comprises clam shells 30 and 36, and has an open top 42 and nip 43, which can be varied in width by pivoting of clam shells 30 and 36 around pivots 35 and 41.

Left clam shell 30 includes end walls 31 and 32 between which are connected a generally upright side wall 33 and a bottom wall 34, the latter being inclined inwardly and downwardly from the side wall towards nip 43 so that the lower edge of the bottom wall defines one longitudinal edge of the opening defined at said nip.

Right clam shell 36 is similar, having an end wall 37 and opposite end wall (not shown), side wall 39 and bottom wall 40.

The inclination of bottom walls 34 and 40 is sufficiently small so that they will bear a significant portion of the weight of material within the clam shell. On the other hand, said inclination is sufficient, and the placement of pivots 35 and 41 is such, that the weight of material borne by the bottom walls exerts an appreciable opening force on the clam shell. Such opening force is opposed by a closing force, produced in any suitable manner using any suitable force generating means. For instance, one may employ pneumatic cylinders 54 and 55 which can press inwards on clam shells 30 and 36 respectively. Mounted on the outside of front and rear walls 20 and 21 of outer casing 16, these pneumatic cylinders have their pistons 52 and 53 connected through holes 56 and 57 to pivots 50 and 51 on clam shells 30 and 36. Extension and retraction of pistons 52 and 53 close and open clam shells 30 and 36.

Clam shell bottom walls 34 and 40 are capable of cooperating with pneumatic cylinders 54 and 55 to respectively increase and decrease the width of the elongated opening defined by nip 43 in response to increased and decreased inventory of material in the distributor 14, while retaining sufficient inventory to keep the entire length of nip 43 covered. These cylinders are connected to a source (not shown) of forced air through pressure regulators (not shown) adapted to relieve the pressure in the lines between the regulators and the cylinders when such pressure exceeds a preset value, and to introduce additional air into the lines and cylinders when the line pressure drops below said preset value. An inventory of feed material having the surface level A shown in FIG. 1 will exert outward pressure on pistons 52 and 53 through inclined bottom walls 34 and 40 and pivots 50 and 51 respectively. These sidewise pressures produce backpressure behind the pistons of pneumatic cylinders 54 and 55, which pressure is communicated through the air supply lines of the cylinders to the above mentioned regulators. The preset pressure for the regulators is selected to be great enough to balance the backpressure produced in the above-described manner by an inventory which only partially fills the feed distributor but is sufficient to cover the entire length of nip 43. Assuming this preset pressure corresponds with level A, an increase in inventory to level B will tend to increase the backpressure. However, since the regulator is such that it relieves backpressure, the cylinders permit clam shells 30 and 36 to open wider, thereby disposing of inventory at a greater rate. If the inventory increases still further, the nip 43 is opened still wider. On the other hand, as the level of inventory drops, and/or the rate of delivery of feed material from conveyor 10 slacks off, the backpressure will drop off too. Upon reduction of backpressure below the set point of the air regulators, they will supply additional air to the cylinders to reduce opening 43.

Although pneumatic cylinders 54 and 55 may be of the single acting type, with or without spring return, double acting cylinders are preferred. Double acting cylinders have the advantage of providing for a positive retract of pistons 52 and 53 for opening the clam shell on an at will or programmed basis. For instance, the apparatus may be provided with a control arrangement including provision for periodically and momentarily opening the clam shell nip 43 wider than "normal" in order to relieve the clam shell of any unusually large particles of feed material, such as 44, which are larger than the normal width of nip 43. A positive opening capability also makes possible a programmed shut-down based on a control system which, upon shutting down of the conveyor, will retract the pistons 52 and 53 and gradually deliver the entire contents of the clam shell to the hammermill 15 before shutting down the hammermill. Thus, no heavy load of material is left hanging overhead when the hammermill is shut down and opened for servicing.

An optional but useful feature of the invention is a generally upright skirt 58. It is defined by front and rear walls 61 and 62, which are outwardly and steeply downwardly inclined, as well as end walls 59 and 60, which may be vertical or inclined in the same manner as walls 61, 62. Fixedly secured to the upper edges of outer casing side walls 22 and 23 by triangular braces 65, the skirt is of sufficient length to extend from the discharge end of conveyor 10, above the clam shell assembly, down through clam shell open top 42 to a position adjacent the bottom walls 34 and 40. The skirt has an open top 63 to receive feed material 13 from conveyor 10, laterally confines the inventory of feed material within itself, and delivers feed material through its open bottom 64 to the nip 43 of the clam shell assembly. Skirt front and rear walls 61 and 62 may have lower edges which terminate well above the nip. See lower edge 66 of front wall 61 in FIG. 2. However, the bottom edges of skirt end walls 59 and 60 are preferably contoured to follow the slope of clam shell bottom walls 34 and 40. For example, they may culminate in an inverted apex adjacent nip 43, as illustrated by lower edge 67 of side wall 59 in FIG. 1.

Although the above described skirt is an optional feature, it provides a number of advantages which favor its use. It tends to focus the weight of the inventory on the bottom walls 34 and 40 of the clam shell elements. In the absence of the skirt, a portion of the weight of the inventory would exert force sidewards against side walls 33 and 39. The effect of this force would vary not only with the weight of the inventory, but also as a function of the level of the inventory, thus introducing an additional complicating factor to be taken into account in the control system for balancing the nip opening versus the quantity of inventory. The upper end of skirt 58 provides a guide for the conveyor discharge. Moreover, the skirt may be regarded as a sacrificial wear-absorbing element. Since most of the wall surfaces of the clam shells and their pivots 35 and 41 are outside the skirt, they are protected from wear; thus the clam shell side and end walls 31–33, 37 and 39 will not require as frequent replacement or can be of lighter construction than would otherwise be possible. Moreover the skirt, being a fixed element with no moving parts, is much easier to fabricate and replace than the clam shell. When the lower edges of the skirt end walls are contoured to follow the slope of the clam shell bottom walls 34 and 40, the inverted apex formed thereby tends to discourage feed material from escaping laterally through the upright triangular opening formed between the end walls of the clam shells, such as between end walls 31 and 37 in FIG. 1. This prevents any resultant non-uniformity of mass flow at the ends of nip 43 and prevents particles of feed material from wedging in the triangular opening and interfering with closure of nip 43.

Hammermill 15 is presented merely as one example of the above defined class of impacting crushers which may be employed in the invention, and is of conventional design. Its housing includes front, rear and side walls 70, 71, 72 and 73, all joined together by a top wall 74. Top wall 74 has an opening 75 in it, corresponding to the hammermill inlet 19, through which material 69, discharged through nip 43, is presented to the rotor to be described below. The open bottom 76 of this housing provides an outlet for crushed product 68. Within the housing, fixedly secured between side walls 72 and 73, is a breaker plate 77, situated below inlet 19. Also secured between side walls 72 and 73 is the cage 78 comprising cage frame members 79, 80 and 81, on which is supported a curved grate 86 having openings 87. The left or upstream end of the cage is supported by a fixed, transverse, horizontal hinge shaft 82, about which it may pivot. The right or downstream end of the cage is suspended from an inset 85 in housing rear wall 71 via jack shaft 84 and pivot 83, whereby the clearance between the cage and the rotor periphery may be adjusted to compensate for wear. Immediately downstream of cage 78 is a kick-off plate 88 having holes 89. The kick-off plate is followed by a tramp iron pocket 91 having a tramp iron deflector 90 above it and a tramp iron pocket plate 92 below, from which collected tramp iron may be periodically removed through a conventional trap door (not shown).

Within the housing of hammermill 15, surrounded by breaker plate 77, cage 78, kickoff plate 88, tramp iron pocket 91, tramp iron deflector 90 and top wall 74, is rotor 94. It comprises a main rotor shaft 95 extending transversely through the apparatus and projecting through side wall 72 and 73, on which it is journalled on suitable bearings 104. Fixed on main shaft 95 perpendicular to its axis at spaced locations between side wall 72 and 73 are a plurality of rotor discs 96, which support sub shafts 97, 98 and 99 parallel to and at uniform and fixed distance from shaft 95. In this embodiment there are seven discs, with six equally spaced portions of each sub shaft being exposed between the discs. Each exposed portion of these sub shafts carries a hammer. The hammers 100, 101 have head and shank portions 102 and 103 respectively, the sub shafts extending through holes of corresponding size in the shanks 103. While the hammers are free to pivot on sub shafts 97–99 upon encountering "uncrushable" objects, the centrifugal force generated by rotation normally causes them to be carried within their shanks extending radially. In the type of hammermill depicted in FIGS. 1 and 2, the optimum position for the feed to penetrate the hammer circle is the "pinch point", i.e. where the breaker plate 77 most nearly approaches the periphery of the circle defined by the radially outstretched hammers. Thus, the nip 43 of the feeder 14 is positioned directly above the pinch point, to which the feed is dropped on a vertical line.

Referring to the hammers bearing reference numerals 100 and 101 in FIG. 2, it will be seen that each group of six hammers on a given sub shaft includes groups or pairs of hammers 101 on the left, 100 in the center and 101 on the right. In the absence of feeder 14, if feed material 13 were discharged directly from conveyor 10 to hammermill 15, most of the feed material would drop into the path of center hammers 100, which would receive most of the wear. Thus, after an extended period of operation, the heads 102 of hammers 100 would be worn down appreciably more than the heads of hammers 101. Such wear would increase the clearance between hammers 100 and grate 86 of cage 78, thus reducing the grinding effectiveness of hammers 100. While this can be compensated to some extent by adjusting cage 78 upward, such adjustment diminishes the clearance between the cage and hammers 101. A continuation of this trend can cause the clearance between cage 78 and hammers 101 to become inadequate before the hammers 100 or 101 are worn out. Thus, in the absence of the present invention, the maximum available cage adjustment may have been used up before all of the hammers 101 have worn out. When the present invention is employed, each of the hammers 100 and 101 "sees" a substantially equal mass of material over an extended period of operation, causing the hammers to wear more evenly. Differences between the wear on hammers 100 and 101 no longer restrict the extent to which hammer wear can be compensated by cage adjustment. Moreover, since the wear is distributed more evenly among the hammers, the period of operation obtained between shutdowns for hammer replacement is extended.

The distributor may take varying forms consistent with the summary of invention set forth above. Diagrammatic drawings of four of the many possible variations appear in FIGS. 3 through 6 herein.

For example, FIG. 3 shows that the casing 16 and skirt 58 may be omitted, and that the means for pivoting and exerting closing force on the clam shell assembly may be different. In this embodiment, the clam shell assembly is supported above an elongated vertical chute 127 extending upwardly from a reversible impactor 121 having the usual reversibly driven rotor 94, anvils 129 and crushed material outlet 76. Extending upwardly from each side of the impactor housing are inverted "V" frame members 128 which support opposite ends of a shaft 126 at their apexes. The clam shell assembly is suspended from this shaft. The respective half clam portions include mutually overlapping portions 120 at the upper ends of their end wall inner edges. Shaft 126 extends through bores in these overlapping portions, and the half clams can pivot around the shaft to change the width of the nip 43. Feed material 13 is delivered into the open top of the clam shell assembly by conveyor 10. The weight of the inventory on the inclined bottom walls of half clams 30 and 36 creates a spreading reaction tending to open the nip 43. This opening force is offset by a closing force generated in springs 123 tensioned between pins 122 on each half clam. In order to assist in the smooth delivery of material from the distributor, the side walls 125 of the clam halves may be made divergent and electrical vibrators 124 may be fitted to the bottom walls thereof. The feed material drops from the nip through height of drop H to the top dead center position of the rotor 94.

FIG. 4 illustrates the fact that the moveable wall portions of the distributor need not pivot, and that the closing force may be generated in spring means acting in compression rather than tension. Like the embodiment of FIGS. 1 and 2, a conveyor 10 is positioned to supply feed material 13 to the open top 64 of skirt 58. Said skirt is mounted within two clam halves 30 and 36 within casing 16, having an open top 17 and bottom outlet 18 and mounted on a hammermill as in FIGS. 1 and 2. However, in this embodiment, the clam halves 30 and 36 are fitted with short axles 131 in each end wall, these axles being fitted with flanged wheels 132 which ride on downwardly and outwardly inclined rails 130 fitted to the vertical walls of outer casing 16. Inward and outward reciprocating movement of the clam halves 30 and 36 on rails 130 open and close the nip 43.

Tracking guidance and closing force for the clam halves 30 and 36 are provided by rods 133 and compression springs 134. The rods are fixedly secured to the side walls of the clam halves and extend outwardly and generally horizontally through holes (not shown) in the vertical side walls of casing 16. Compression springs 134 are fitted around rods 133 between the clam side walls and the casing side walls. The spacing between these walls, and the size and compressive force of these springs are selected to exert sufficient closing force on the clams whereby the width of nip 43 will be maintained small enough to keep it covered with inventory over its entire length whenever it is delivering feed material.

In the FIG. 5 embodiment, the enclosure which confines and distributes the inventory of feed material has a stationary vertical wall and a half clam which reciprocates vertically with respect to the stationary wall to define and vary the width of the opening through which the feed material is presented to the hammermill. As shown in FIG. 5, a conveyor 10 is positioned to discharge feed material 13 into the open top 152 of a half clam 139 defined by an end wall 140, side wall 141, another end wall (not shown) coinciding with end wall 140 at the opposite end of side wall 141, and a bottom wall 142. While the right side of half clam 139 is open, it directly adjoins a wall member 143 sufficiently wide to cover the entire open side of the clam. Wall 143 is held in fixed position above the hammermill inlet by framework (not shown). Half clam 139 is mounted to reciprocate upwardly and downwardly against stationary wall 143 to vary the width of the vertical, horizontally elongated nip 153 formed between the lower edge of wall 143 and bottom wall 142 of the half clam. Reciprocation is provided by a rail and roller assembly. A rail 144 of circular cross-section is secured to stationary wall member 143 and held alongside each of the clam side walls by horizontal frame members 145 and 146. Rail 144 is captively held between two pairs of rollers 148 mounted on stub shafts 147 extending outwardly from each of the half clam side walls. The peripheries of the rollers have semi-circular cross-sections matching the cross-sections of the rail 144. The weight of inventory inside the half clam urges it downward along the rails while the side wall 143 is held stationary. Discharge of material through nip 153 is assisted by the downward and outward divergency of side wall 141 and an eliptical weight agitator 154 on bottom wall 142 which imparts an up and down motion. Closing force is provided by tensioned spring means 149, stretched between pins 150 and 151, fixedly secured on stationary wall 143 and half clam end wall 140, respectively. The pin placement, spring length and spring tension are selected to provide sufficient closing force so that nip 153 is maintained small emough so that the distributor will retain the inventory of feed material unless the nip is covered.

FIG. 6 shows that the enclosure of the feed distributor need not be a clam. Conveyor 10 is positioned to discharge feed material 13 into a generally vertical open top enclosure 160 defined by downwardly diverging front, side and rear walls 161, 162 and 163. The enclosure includes a bottom wall which is both moveable and moving, e.g. conveyor 171. The conveyor is of sufficient width and length to extend laterally all the way from side wall 162 to its opposite side wall (not shown), and to extend longitudinally almost all of the way from rear wall 163 to front wall 161, leaving an elongated opening 173 whose width can be varied in a manner explained below. Conveyor 171 is mounted on a frame 166 which carries axles 167 and 168 for conveyor belt rolls 169 and 170 respectively. The opposite end of frame 166 carries a weight 172. The entire frame 166, conveyor 171 and weight 172 are carried on a fixed support (not shown), to which they are attached by lateral extensions of shaft 167. Because shaft 167 is held at a fixed position in space, frame 166 and conveyor 171 can pivot between the indicated positions $P_1$ and $P_2$. Weight 172 counterbalances the weight of the conveyor and the inventory of material which is present on it within enclosure 160. If the unit is running in position $P_1$ with an inventory indicated by the level line $L_2$ within enclosure 160, and the output of conveyor 10 increases, raising the level of the inventory to level $L_2$, the additional weight on the conveyor will tilt the frame to position $P_2$, dropping the left end of the conveyor and enlarging the opening 173. Thus the width of the opening is enlarged from the indicated dimension $W_1$ to dimension $W_2$. As the inventory is reduced by the increased mass flow discharge rate resulting from enlargement of opening 173 and/or by a decrease in the delivery rate from the conveyor 10, the inventory level will drop and weight 172 will lift the left end of conveyor 171 to decrease the width of opening 173. A suitable stop (not shown) is provided to prevent conflict between the conveyor 171 and enclosure wall 163. If the unit is designed so that opening 173 will never completely close, the opening size, delivery rate of conveyor 10, and operating speed of conveyor 171 can be selected to keep opening 173 covered with inventory at all times. If desired, and upwardly displaceable flap 165 having hinge 164 may be provided to assist in the discharge of oversize pieces of feed material.

From the foregoing it may be seen that the invention may be embodied in a variety of ways. With the benefit of the foregoing disclosure persons skilled in the art will readily devise additional embodiments without departing from the spirit of the invention. Therefore the appended claims are to be construed as including the foregoing embodiments and all equivalents thereof.

What is claimed is:

1. Apparatus comprising in combination an impacting crusher and a feed distributor; said impacting crusher having an inlet, a rotor within the housing and an outlet, the rotor comprising a shaft having rotating impact members mounted thereon and extending outwardly from the shaft along a given length of said shaft to define a relatively wide rotor, the width of said inlet being substantially equal to or greater than the width of the rotor; said distributor including an enclosure defined by confining means for surrounding an inventory of material laterally and from beneath, said confining means including a moveable supporting member defining a portion of the enclosure and being positioned to bear at least a portion of the weight of the inventory, said enclosure being openable to define an opening which is presented to the rotor, is elongated in a horizontal direction generally parallel to the rotor axis, is about as long as the width of the rotor, is positioned with its ends substantially above the ends of the rotor and is of substantially uniform width across the width of the rotor, said moveable member being connected with closing means having the property of exerting sufficient closing force on said moveable member to keep the entire length of said opening covered by said inventory while said inventory is flowing through the opening, and being responsive to the inventory present in the enclosure for moving said moveable member and respectively decreasing and increasing the width of said opening in response to decreased and increased inventory, whereby such apparatus will cause the material passing through said opening to be distributed substantially uniformly across the length of the opening, so that the side and central portions of the rotor will receive substantially equal quantities of the material over an extended period of operation.

2. Apparatus according to claim 1, wherein said rotor comprises a main shaft, a plurality of rotor discs mounted at axially spaced positions on said rotor shaft, a plurality of sub shafts carried at peripherially space positions around said discs parallel to and spaced radially from the main shaft, and a plurality of impact members mounted at axially spaced locations on said sub shafts.

3. Apparatus according to claim 2, wherein said rotor is mounted for grinding in cooperation with an adjustable cage.

4. Apparatus according to claim 1, wherein said impact means are hammers having shank and head portions.

5. Apparatus according to claim 1, wherein said rotor is mounted for grinding in cooperation with an adjustable cage.

6. Apparatus according to claim 1, wherein said enclosure has generally upright side walls which diverge outwardly in a downward direction.

7. Apparatus according to claim 1, wherein said opening is defined by a plurality of moveable supporting members.

8. Apparatus according to claim 7, wherein a generally vertical fixed skirt is secured within said moveable support members.

9. Apparatus according to claim 8, wherein said skirt includes side walls which diverge outwardly in a downward direction.

10. Apparatus according to claim 7, wherein said moveable supporting members include bottom walls sloping downward towards said opening.

11. Apparatus according to claim 7, wherein said moveable supporting members include side, end and bottom walls, said bottom walls sloping downward towards said opening, each of said moveable supporting members defining half of an open top enclosure with said opening at the bottom, said halves being pivotally mounted to open and close in the manner of a clam shell.

12. Apparatus according to claim 11 wherein a fixed skirt member is secured within said moveable support members, said skirt member having end walls which are configured to conform to the slope of the bottom walls of said clam shell assembly to culminate in an inverted apex adjacent the ends of said opening.

13. Apparatus according to claim 1, wherein the means for exerting closing force includes spring means.

14. Apparatus according to claim 13 wherein said opening is defined by a plurality of moveable support means, said spring means being secured to each of said moveable support means in position to develop tension for closing said opening.

15. Apparatus according to claim 1, including a conveyor positioned to direct feed material into said feed distributor, said conveyor being sufficiently narrower than said rotor so that the discharge therefrom would wear the rotor unevenly in the absence of said feed distributor.

16. A feed distributor including an enclosure defined by confining means for surrounding an inventory of material laterally and from beneath, said confining means including at least one moveable member having intersecting side, end and bottom walls, said side walls being generally upright, said bottom walls sloping downwardly and inwardly from said side walls, said moveable member being moveable to define between itself and an adjoining portion of said confining means an opening which is elongated in a horizontal direction, which is of substantially uniform width across the enclosure and which is in position to release material in substantially vertical free fall, said moveable member being connected with closing means having the property of exerting sufficient closing force on said moveable member to keep the entire length of said opening covered by said inventory while said inventory is flowing through the opening, and being responsive to the inventory present in the enclosure for moving said moveable member and respectively decreasing and increasing the width of said opening in response to decreased and increased inventory, whereby such apparatus will cause the material passing through said opening to be distributed substantially uniformly across the length of the opening.

17. Apparatus according to claim 16 wherein said opening is horizontal.

18. A feed distributor including an enclosure defined by confining means for surrounding an inventory of material laterally and from beneath, said confining means including a pair of moveable members having intersecting side, end and bottom walls, said side walls being generally upright, said bottom walls sloping downwardly and inwardly from said side walls, said moveable members being moveable, and said bottom walls including edges, for defining between them an opening which is elongated in a horizontal direction, which is of substantially uniform width across the enclosure and which is in position to release material in substantially vertical free fall, said moveable members being connected with closing means having the property of exerting sufficient closing force on said moveable members to keep the entire length of said opening covered by said inventory while said inventory is flowing through the opening, and being responsive to the inventory present in the enclosure for moving said moveable members and respectively decreasing and increasing the width of said opening in response to decreased and increased inventory, whereby such apparatus will cause the material passing through said opening to be distributed substantially uniformly across the length of the opening.

19. Apparatus according to claim 18 wherein said opening is horizontal.

20. Apparatus according to claim 18 wherein said moveable members are pivotally mounted on pivot means for opening and closing in the manner of a clam shell.

21. Apparatus according to claim 20 wherein said pivot means is above said opening.

22. Apparatus according to claim 18 including a skirt member having generally upright walls and an open top and bottom secured within said enclosure for isolating feed material within said skirt from the side walls of said enclosure.

23. A feed distributor including an enclosure defined by confining means for surrounding an inventory of material laterally and from beneath, said confining means including at least one moveable member and a skirt member, said moveable member having intersecting side, end and bottom walls, said side walls being generally upright, said bottom walls sloping downwardly and inwardly from said side walls, said moveable member being moveable to define between itself and an adjoining portion of said confining means an opening which is elongated in a horizontal direction, which is of substantially uniform width across the enclosure and which is in position to release material in substantially vertical free fall, said skirt member having generally upright walls and an open top and bottom secured within said enclosure for isolating feed material within said skirt from the side walls of said moveable member, said moveable member being connected with closing means having the property of exerting sufficient closing force on said moveable member to keep the entire length of said opening covered by said inventory while said inventory is flowing through the opening, and being responsive to the inventory present in the enclosure for moving said moveable member and respectively decreasing and increasing the width of said opening in response to decreased and increased inventory, whereby such apparatus will cause the material passing through said opening to be distributed substantially uniformly across the length of the opening.

24. A method comprising: feeding particulate solid feed material, in a stream having a given maximum horizontal dimension and characterized by uniform or variable flow rate and particle size, from a conveyor to an enclosure; maintaining an inventory of the material in the enclosure; feeding material from said inventory to a rotor of an impacting crusher through an opening in the enclosure which is elongated in a horizontal direction generally parallel to the rotor axis, which is about as long as the width of the rotor, which is positioned with its ends substantially above the ends of the rotor and which is of substantially uniform width across the width of the rotor; and respectively decreasing and increasing the opening width as the inventory decreases and increases, while maintaining the opening sufficiently small to keep the opening covered with said inventory.

25. A method according to claim 24 wherein the feeding of material from said inventory includes releasing the material from said opening in vertical free fall.

26. Method according to claim 24 wherein said impacting crusher is a reversible impacting crusher and said material is dropped from said opening in vertical free fall to the top dead center position of the rotor.

27. A method according to claim 24 wherein the periphery of the rotor defines a hammer circle and the material is released from the opening at a predetermined height above the rotor and is caused to move toward the rotor without substantial redirecting of its path by intervening guide members until the material penetrates the hammer circle.

* * * * *